US010150547B1

(12) United States Patent
Pelini

(10) Patent No.: US 10,150,547 B1
(45) Date of Patent: Dec. 11, 2018

(54) MANUAL JACK PLATE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 0 days.

(21) Appl. No.: 15/858,582

(22) Filed: Dec. 29, 2017

(51) Int. Cl.
*B63H 20/10* (2006.01)
*B63H 20/06* (2006.01)

(52) U.S. Cl.
CPC ..... *B63H 20/106* (2013.01); *B63H 20/06* (2013.01)

(58) Field of Classification Search
CPC ..... B63H 20/106; B63H 20/10; B63H 20/08; B63H 20/06
See application file for complete search history.

(56) References Cited

U.S. PATENT DOCUMENTS 6,132,271 A * 10/2000 Hebert ..... B63H 20/06 440/53
7,731,552 B1 6/2010 Pelini

* cited by examiner

*Primary Examiner* — Andrew Polay
(74) *Attorney, Agent, or Firm* — Edward P Dutkiewicz

(57) ABSTRACT

There is a transom component having at least one travel slot there through. An upper lift bar is coupled to the transom component. There is a lower lift bar. The upper and lower lift bars have a coupling lifting bolt. The lifting bolt has a threaded shaft, hexagonal head, and an associated locking nut. The lifting bolt couples the upper lift bar and the lower lift bar. There is a motor component which has a pair of bolt holes there through, with associated bolts for coupling the lower lift bar to the motor component.

12 Claims, 5 Drawing Sheets

FIG. 1
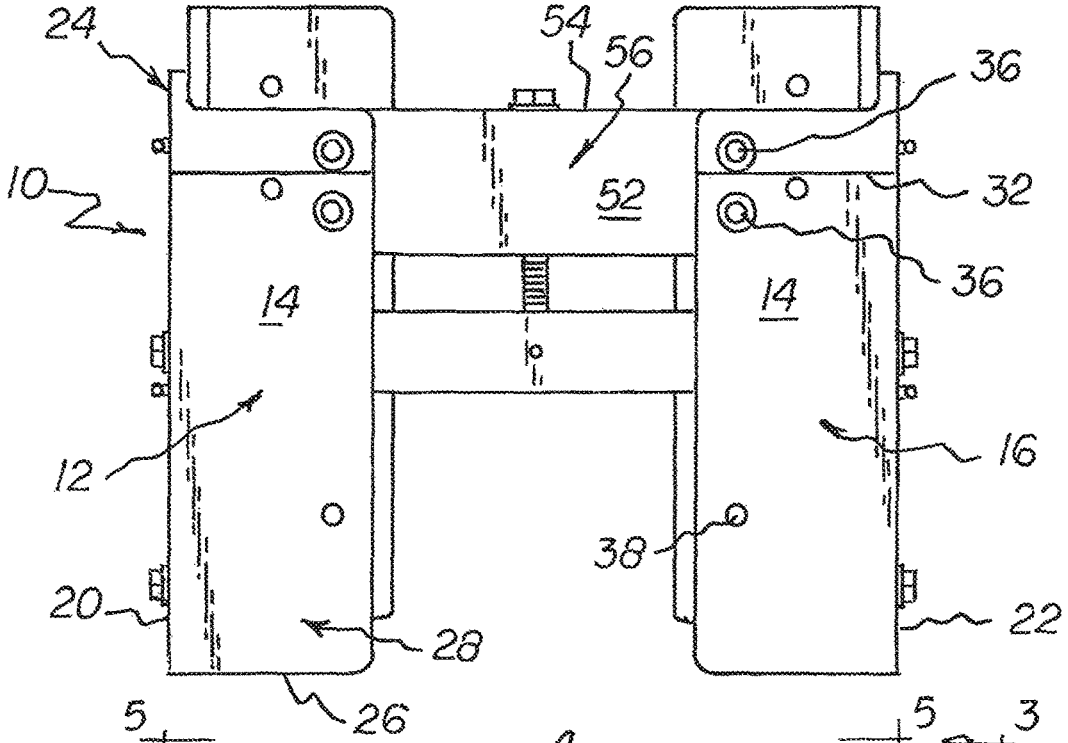
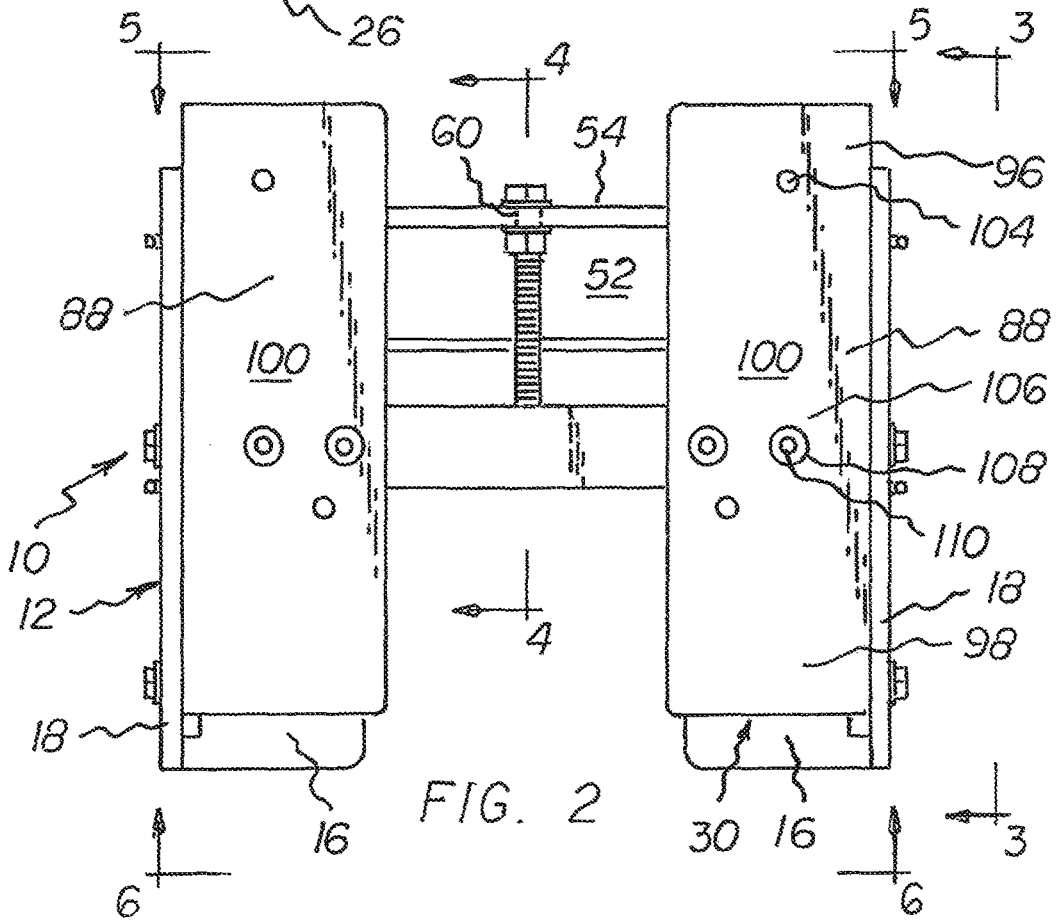
FIG. 2

FIG. 5
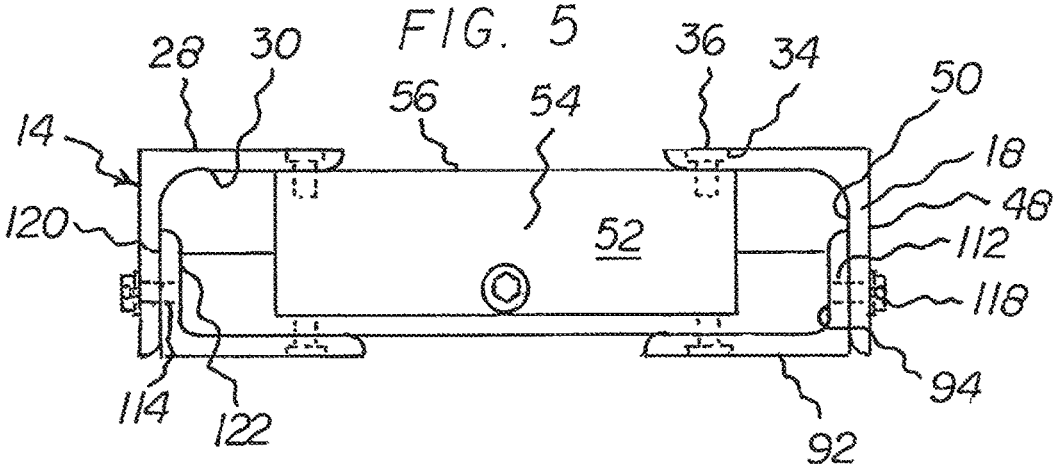
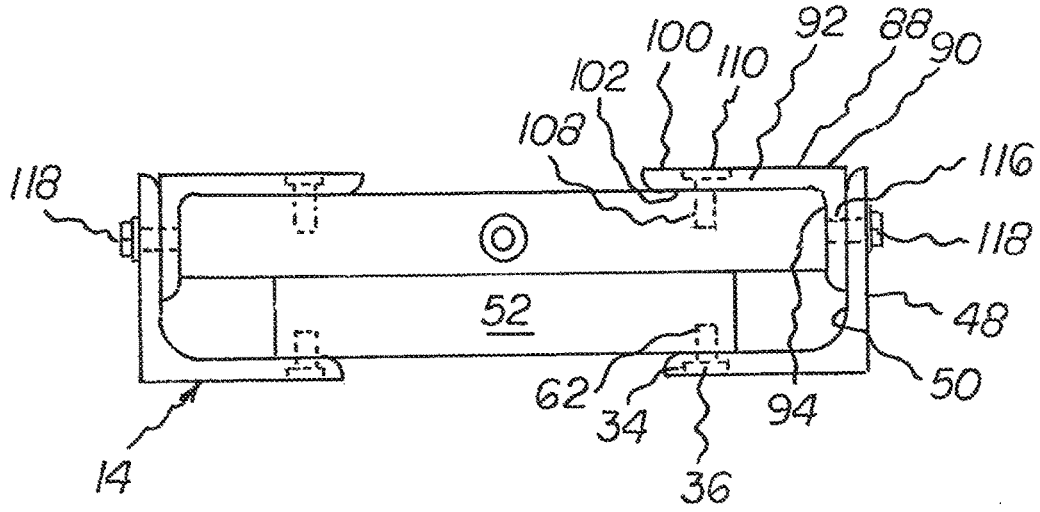
FIG. 6

MANUAL JACK PLATE

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a manual jack plate and more particularly pertains to a manual device to safely raise or lower an outboard motor.

DESCRIPTION OF THE PRIOR ART

The use of manually operated devices to raise or lower an outboard motor are known in the prior art. More specifically, manually operated devices to raise or lower an outboard motor, previously devised and utilized for the purpose of manually raising or lowering an outboard motor, are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe manual jack plate that allows a use to manually and safely raise or lower an outboard motor.

In this respect, the manual jack plate according to the present invention substantially departs from the conventional concepts and designs of the prior art, and in doing so provides an apparatus primarily developed for the purpose of a safely raising or lowering an outboard motor.

Therefore, it can be appreciated that there exists a continuing need for a new and improved manual jack plate which can be used to manually and safely raise or lower an outboard motor. In this regard, the present invention substantially fulfills this need.

SUMMARY OF THE INVENTION

In view of the foregoing disadvantages inherent in the known types of manually operated devices to raise or lower an outboard motor now present in the prior art, the present invention provides an improved manual jack plate. As such, the general purpose of the present invention, which will be described subsequently in greater detail, is to provide a new and improved manual jack plate which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the objects of the invention, the present invention essentially comprises a manually operated jack plate comprising several components, in combination.

There is a transom component. The transom component is fabricated of a rigid material. The transom component has a pair of generally mirror image L-shaped transom mount elements. Each transom mount element has a transom portion and a rearwardly directed portion. The pair of generally mirror imaged L-shaped transom mount elements being a right L-shaped transom mount element and a left L-shaped transom mount element.

Each L-shaped transom mount element transom portion has a upper end and a lower end. The upper end and the lower end of each of the transom mount elements is continuous.

Each transom mount element has a transom surface and a rearward surface, with a thickness there between. The upper ends of each of the transom mount elements, transom surfaces, has a step therein.

Each transom component transom mount element upper end has a pair of upper lift bar bolt mount bolt holes there through. Each upper lift bar bolt mount hole has an associated upper lift bar bolt.

Each transom mount element has a pair of transom mounting bolt holes there through. Each transom component transom mount element rearwardly directed portion has a pair of grease zerk holes there through. Each grease zerk hole has an associated grease zerk.

Each transom component transom mount element rearwardly directed portion has a pair travel slots there through. The pair of travel slots are an upper slot and a lower slot.

Each transom component transom mount element rearwardly directed portion has an outer surface and an inner surface, with a thickness there between.

There is an upper lift bar. The upper lift bar is fabricated of a rigid material. The upper lift bar has a generally L-shaped configuration with a right side and a left side, with a length there between. The upper lift bar has a horizontally oriented top portion and a vertically oriented forward portion. The horizontally oriented top portion of the upper lift bar has a centrally located lifting bolt hole there through. The upper lift bar vertically oriented forward portion has a pair of bolt holes there through. The upper lift bar vertically oriented forward portion pair of bolt holes are aligned with the upper lift bar bolt mount hole of the transom component and are coupled thereto by the associated upper lift mechanism bolt.

There is a lower lift bar. The lower lift bar is fabricated of a rigid material. The lower lift bar has a generally rectilinear configuration, with a right side and a left side, with a length there between. The lower lift bar has a horizontally oriented top surface, a horizontally oriented bottom surface, a vertically oriented forward transom surface, and a vertically oriented rearward motor surface. The top surface of the upper lift bar has a centrally located threaded lifting bolt hole there through. The lower lift bar vertically oriented rearward motor surface has a pair of threaded bolt holes there in.

There is a lifting bolt. The lifting bolt has a threaded shaft and a hexagonally shaped head. The lifting bolt threaded shaft is configured to be threadedly mated with, and received by, the threaded lifting bolt hole of the lower lift bar. The threaded lifting bolt shaft passes through the lifting bolt hole of the upper bar and the threaded hole of the lower lift bar. The lifting bolt has an associated lock nut.

Lastly, there is a motor component. The motor component is fabricated of a rigid material. The motor component has a pair of generally mirror image L-shaped motor mount elements, with each motor mount element having a motor portion and a forwardly directed portion. The pair of generally mirror imaged L-shaped motor mount elements are a right L-shaped motor mount element and a left L-shaped motor mount element. Each L-shaped motor mount element motor portion has a upper end and a lower end. The upper end and the lower end of each of the motor mount elements are continuous. Each motor mount element has a motor surface and a forward surface, with a thickness there between. Each motor component motor mount element has a pair of motor mount bolt holes there through. Each motor component motor mount element has a center portion, with the center portion of each motor component motor mount element having a pair of lower lift bar bolt holes there through. Each lower lift bar bolt hole has an associated lower lift bar bolt.

Each motor component motor mount element forwardly directed portion has a pair threaded travel bolt holes there through. The pair of threaded travel bolt holes are an upper travel bolt hole and a lower travel bolt hole, with each travel bolt hole having an associated travel bolt. Each motor component motor mount element forwardly directed portion has an outer surface and an inner surface, with a thickness there between.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manual jack plate which has all of the advantages of the prior art, being manually operated devices which are used to raise or lower an outboard motor, and none of the disadvantages.

It is another object of the present invention to provide a new and improved manual jack plate which may be easily and efficiently manufactured and marketed.

It is further object of the present invention to provide a new and improved manual jack plate which is of durable and reliable constructions.

An even further object of the present invention is to provide a new and improved manual jack plate which is susceptible of a low cost of manufacture with regard to both materials and labor, and which accordingly is then susceptible of low prices of sale to the consuming public, thereby making such manual jack plate economically available to the buying public.

Even still another object of the present invention is to provide a manual jack plate for allowing a user to safely raise or lower an outboard motor.

Lastly, it is an object of the present invention to provide a new and improved jack plate having a transom component, with the transom component having at least one travel slot there through. An upper lift bar is coupled to the transom component. There is a lower lift bar. The upper and lower lift bars have a coupling lifting bolt. The lifting bolt has a threaded shaft, hexagonal head, and an associated locking nut. The lifting bolt couples the upper lift bar and the lower lift bar. There is a motor component which has a pair of bolt holes there through, with associated bolts for coupling the lower lift bar to the motor component.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given the following detailed description thereof. Such description makes reference to the annexed drawings wherein:

FIG. 1 is side elevational view showing the transom side, or forward side, of the device.

FIG. 2 is a side elevational view showing the motor side, or rearward side, of the device.

FIG. 5 is a view taken along line 5-5 of FIG. 2

FIG. 6 is a view taken along line 6-6 of FIG. 2.

The same reference numerals refer to the same parts throughout the various Figures.

DESCRIPTION OF THE PREFERRED EMBODIMENT

Figure 3:
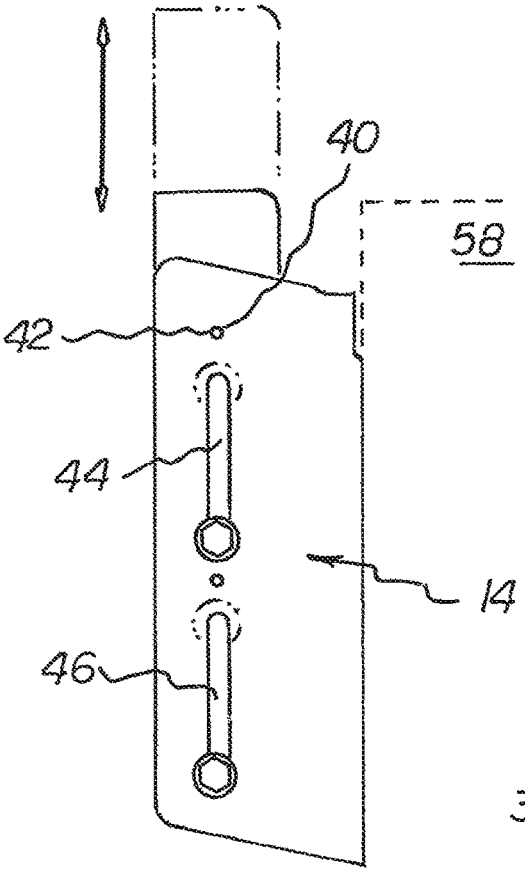
FIG. 3 is a view taken along line 3-3 of FIG. 2.
Figure 4:
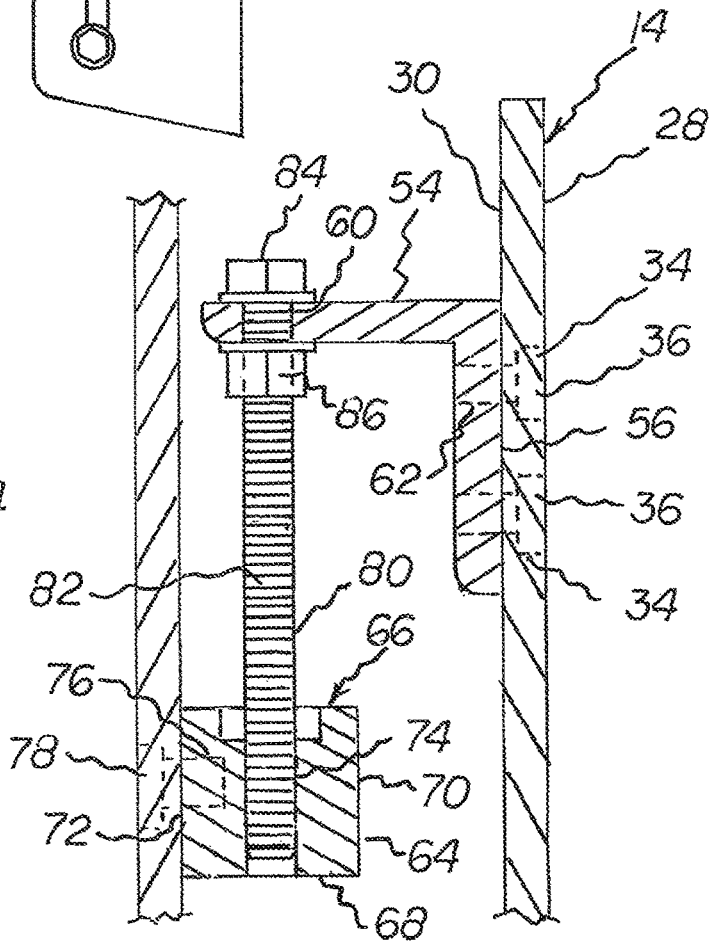
FIG. 4 is a view taken along line 4-4 of FIG. 2
Figure 7:
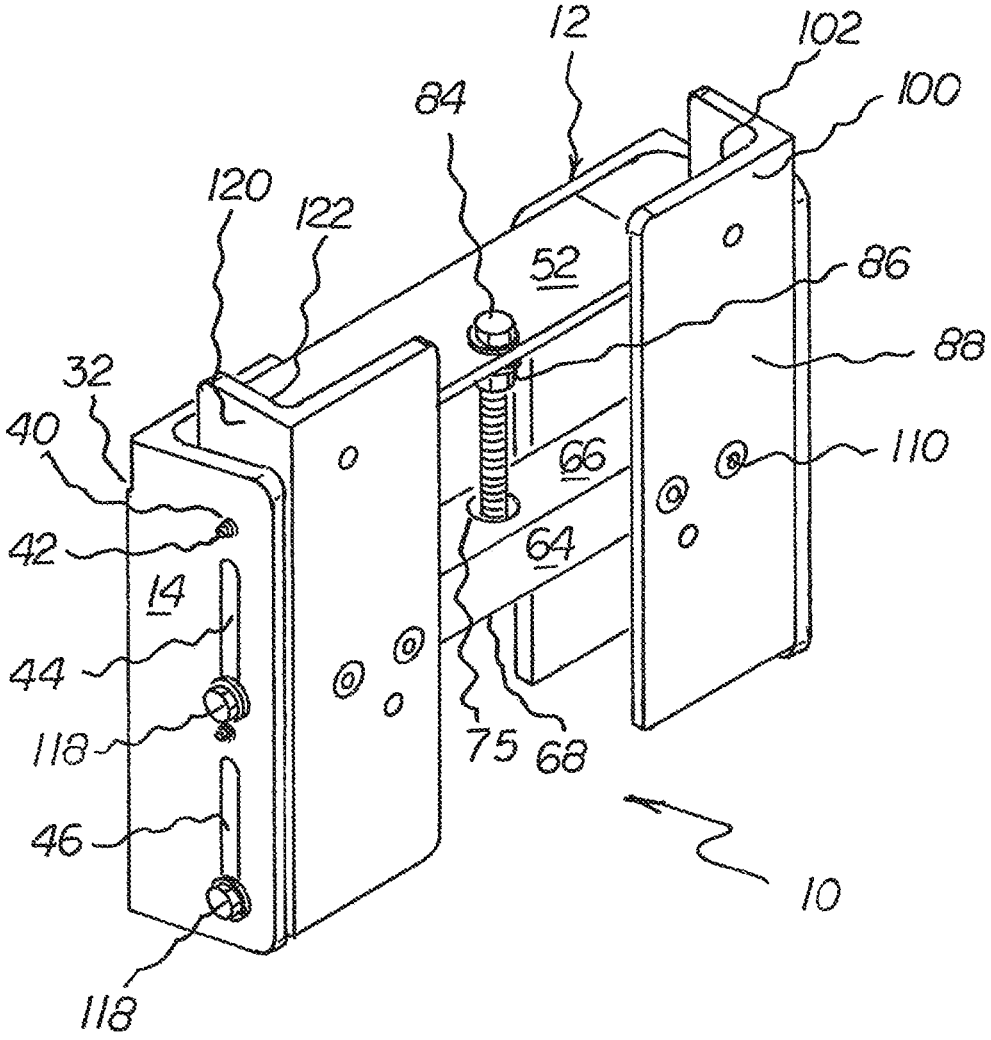
FIG. 7 is a rear and upper perspective view.
Figure 8:
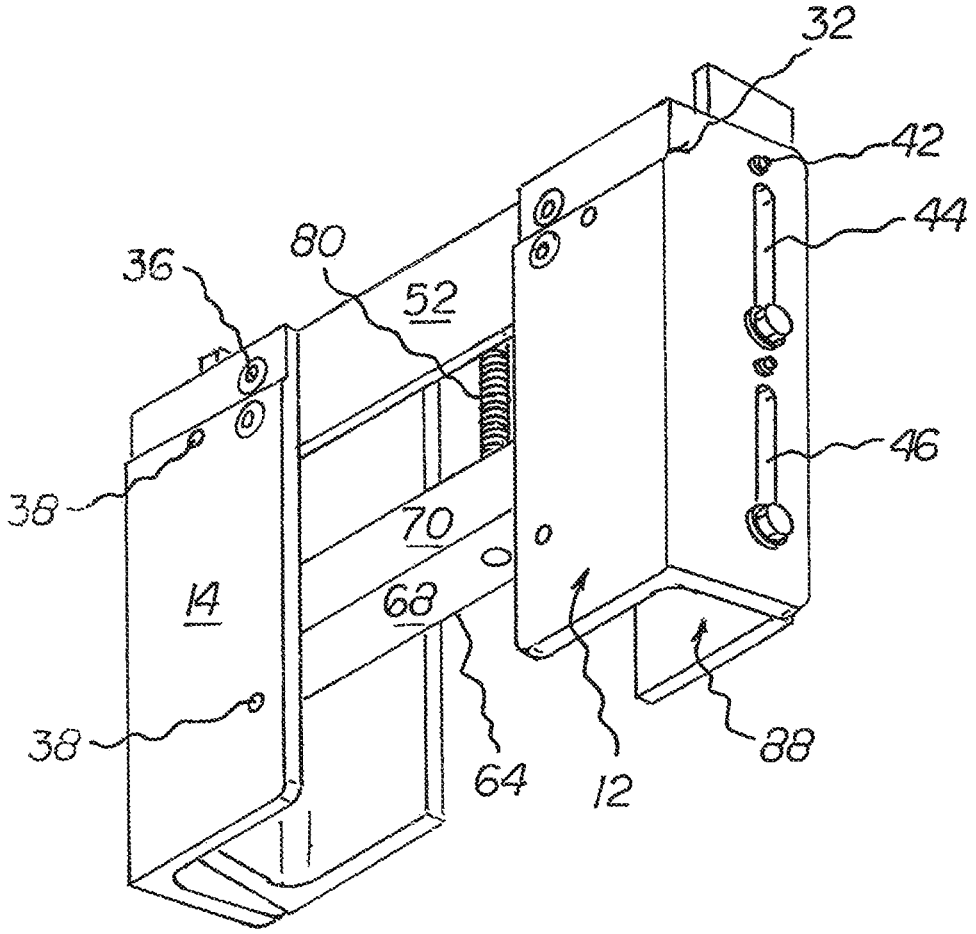
FIG. 8 is a forward and lower perspective view.

With reference now to the drawings, and in particular to FIG. 1 thereof, the preferred embodiment of the new and improved manual jack plate embodying the principles and concepts of the present invention and generally designated by the reference numeral 10 will be described.

The present invention, the manual jack plate 10 is comprised of a plurality of components. Such components in their broadest context include a transom component, a motor component, a pair of lift bars and a lifting bolt. Such components are individually configured and correlated with respect to each other so as to attain the desired objective.

A manually operated jack plate 10 comprising several components, in combination, is herein described.

There is a transom component 12. The transom component is fabricated of a rigid material. The transom component has a pair of generally mirror image L-shaped transom mount elements 14. Each transom mount element has a transom portion 16 and a rearwardly directed portion 18. The pair of generally mirror imaged L-shaped transom mount elements being a right L-shaped transom mount element 20 and a left L-shaped transom mount element 22. Right and left is taken from a view from behind an outboard motor, looking forward toward the bow of the boat to which the jack plate is attached.

Each L-shaped transom mount element transom portion has a upper end 24 and a lower end 26. The upper end and the lower end of each of the transom mount elements is continuous.

Each transom mount element has a transom surface 28 and a rearward surface 30, with a thickness there between. The upper ends of each of the transom mount elements, transom surfaces, has a step 32 therein.

Each transom component transom mount element upper end has a pair of upper lift bar bolt mount bolt holes 34 there through. Each upper lift bar bolt mount hole has an associated upper lift bar bolt 36.

Each transom mount element has a pair of transom mounting bolt holes there through 38. Each transom component transom mount element rearwardly directed portion has a pair of grease zerk holes 40 there through. Each grease zerk hole has an associated grease zerk 42.

Each transom component transom mount element rearwardly directed portion has a pair travel slots there through. The pair of travel slots are an upper slot 44 and a lower slot 46.

Each transom component transom mount element rearwardly directed portion has an outer surface 48 and an inner surface 50, with a thickness there between.

There is an upper lift bar 52. The upper lift bar is fabricated of a rigid material. The upper lift bar has a generally L-shaped configuration with a right side and a left side, with a length there between. The upper lift bar has a horizontally oriented top portion 54 and a vertically oriented forward portion 56 which is oriented toward the transom of an exiting boat 58. The horizontally oriented top portion of the upper lift bar has a centrally located lifting bolt hole 60 there through. The upper lift bar vertically oriented forward portion has a pair of bolt holes 62 there through. The upper lift bar vertically oriented forward portion pair of bolt holes are aligned with the upper lift bar bolt mount hole of the transom component and are coupled thereto by the associated upper lift mechanism bolt 36.

There is a lower lift bar 64. The lower lift bar is fabricated of a rigid material. The lower lift bar has a generally rectilinear configuration, with a right side and a left side, with a length there between. The lower lift bar has a horizontally oriented top surface 66, a horizontally oriented bottom surface 68, a vertically oriented forward transom surface 70, and a vertically oriented rearward motor surface 72. The top surface of the upper lift bar has a centrally located threaded lifting bolt hole 74 there through. The threaded lifting bolt hole has a enlarged recess there around 75. The lower lift bar vertically oriented rearward motor surface has a pair of threaded bolt holes 76 there in. The motor surface threaded bolt holes have associated bolts 78.

There is a lifting bolt 80. The lifting bolt has a threaded shaft 82 and a hexagonally shaped head 84. The lifting bolt threaded shaft is configured to be threadedly mated with, and received by, the threaded lifting bolt hole of the lower lift bar. The threaded lifting bolt shaft passes through the lifting bolt hole of the upper bar and the threaded hole of the lower lift bar. The lifting bolt has an associated lock nut 86.

Lastly, there is a motor component 88. The motor component is fabricated of a rigid material. The motor component has a pair of generally mirror image L-shaped motor mount elements 90, with each motor mount element having a motor portion 92 and a forwardly directed portion 94. The pair of generally mirror imaged L-shaped motor mount elements are a right L-shaped motor mount element and a left L-shaped motor mount element. Each L-shaped motor mount element motor portion has a upper end 96 and a lower end 98. The upper end and the lower end of each of the motor mount elements are continuous.

Each motor mount element has a motor surface 100 and a forward surface 102, with a thickness there between. Each motor component motor mount element has a pair of motor mount bolt holes 104 there through. Each motor component motor mount element has a center portion 106, with the center portion of each motor component motor mount element having a pair of lower lift bar bolt holes 108 there through. Each lower lift bar bolt hole has an associated lower lift bar bolt 110.

Each motor component motor mount element forwardly directed portion has a pair threaded travel bolt holes 112 there through. The pair of threaded travel bolt holes are an upper travel bolt hole 114 and a lower travel bolt hole 116, with each travel bolt hole having an associated travel bolt 118. Each motor component motor mount element forwardly directed portion has an outer surface 120 and an inner surface 122, with a thickness there between.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A manually operated jack plate comprising, in combination:

a transom component having a pair of generally mirror image L shaped transom mount elements with each transom mount element having a transom portion and a rearwardly directed portion, each transom mount element having a transom surface and a rearward surface with a thickness there between, with each transom component transom mount element rearwardly directed portion having at least one travel slot there through;

an upper lift bar having a generally L shaped configuration with a right side and a left side with a length there between, the upper lift bar being coupled to the transom component;

a lower lift bar having a generally rectilinear configuration with a right side and a left side with a length there between, the lower lift bar being coupled to the motor component;

a lifting bolt having a threaded shaft and a head, the lifting bolt coupling the upper lift bar and the lower lift bar; and a motor component having a pair of generally mirror image L shaped motor mount elements with each motor mount element having a motor portion and a forwardly directed portion, each motor mount element having a motor surface and a forward surface with a thickness there between, with each motor component motor mount element forwardly directed portion having at least one threaded travel bolt hole there through, each motor component motor mount element forwardly directed portion having an outer surface and an inner surface with a thickness there between.

2. The manually operated jack plate as described in claim 1 with the jack plate further comprising:

the at least one travel slot being a pair of travel slots being an upper slot and a lower slot, each transom component transom mount element rearwardly directed portion having an outer surface and an inner surface with a thickness there between; and the at least one threaded travel bolt hole being a pair of threaded travel bolt holes being an upper travel bolt hole and a lower travel bolt hole with each travel bolt hole having an associated travel bolt.

3. The manually operated jack plate as described in claim 2 with the jack plate further comprising:

each transom component transom mount element upper end having a pair of upper lift bar bolt mount bolt holes there through with each upper lift bar bolt mount hole having an associated upper lift bar bolt; and the upper lift bar having a horizontally oriented top portion and a vertically oriented forward portion.

4. The manually operated jack plate as described in claim 3 with the jack plate further comprising:

the pair of generally mirror imaged L-shaped transom mount elements being a right L-shaped transom mount element and a left L-shaped transom mount element;

the lower lift bar having a horizontally oriented top surface and a horizontally oriented bottom surface and a vertically oriented forward transom surface and a vertically oriented rearward motor surface; and the pair of generally mirror imaged L-shaped motor mount elements being a right L-shaped motor mount element and a left L-shaped motor mount element.

5. The manually operated jack plate as described in claim 4 with the jack plate further comprising:

each L-shaped transom mount element transom portion having a upper end and a lower end with the upper end and the lower end of each of the transom mount elements being continuous;

the horizontally oriented top portion of the upper lift bar having a centrally located lifting bolt hole there through;

the lower lift bar horizontally oriented top surface having a threaded lifting bolt hole there through; and each L-shaped motor mount element motor portion having a upper end and a lower end with the upper end and the lower end of each of the motor mount elements being continuous.

6. The manually operated jack plate as described in claim 5 with the jack plate further comprising:

each transom mount element having a pair of transom mounting bolt holes there through;

the upper lift bar vertically oriented forward portion having a pair of bolt holes there through;

the top surface of the upper lift bar having a centrally located threaded lifting bolt hole there through;

the lifting bolt threaded shaft being configured to be threadedly mated with and received by the threaded lifting bolt hole of the lower lift bar; and each motor component motor mount element having a pair of motor mount bolt holes there through.

7. The manually operated jack plate as described in claim 6 with the jack plate further comprising:

the upper lift bar vertically oriented forward portion pair of bolt holes being aligned with the upper lift bar bolt mount hole of the transom component and being coupled thereto by the associated upper lift bar bolt;

the lower lift bar vertically oriented rearward motor surface having a pair of bolt holes there in;

the threaded lifting bolt shaft passing through the lifting bolt hole of the upper bar and the threaded hole of the lower lift bar, the lifting bolt having an associated lock nut; and each motor component motor mount element having a center portion with the center portion of each motor component motor mount element having a pair of lower lift bar bolt holes there through, with each lower lift bar bolt hole having an associated lower lift bar bolt.

8. The manually operated jack plate as described in claim 7 with the jack plate further comprising:

each of the upper end of each of the transom mount elements transom surface having a step therein; and each transom component transom mount element rearwardly directed portion having a pair of grease zerk holes there through with each grease zerk hole having an associated grease zerk.

9. The manually operated jack plate as described in claim 8 with the jack plate further comprising:

the transom component being fabricated of a rigid material;

the upper lift bar being fabricated of a rigid material;

the lower lift bar being fabricated of a rigid material; and the motor component being fabricated of a rigid material.

10. A manually operated jack plate comprising, in combination:

a transom component having at least one travel slot there through, the transom component being a pair of generally mirror image L shaped transom mount elements;

an upper lift bar being coupled to the transom component with the upper lift bar having a generally L shaped configuration with a right side and a left side with a length there between;

a lower lift bar with the lower lift bar having a generally rectilinear configuration with a right side and a left side with a length there between;

a lifting bolt having a threaded shaft and a head, the lifting bolt coupling the upper lift bar and the lower lift bar; and a motor component having a pair of generally mirror image L shaped motor mount elements with each motor mount element having a motor portion and a forwardly directed portion, each motor mount element having a motor surface and a forward surface with a thickness there between, with each motor component motor mount element forwardly directed portion having at least one threaded travel bolt hole there through, each motor component motor mount element forwardly directed portion having an outer surface and an inner surface with a thickness there between, the motor component having a pair of generally mirror image L shaped motor mount elements; and the lower lift bar being coupled to the motor component.

11. The manually operated jack plate as described in claim 10 with the jack plate further comprising:

each transom mount element having a transom portion and a rearwardly directed portion; and each motor mount component having a motor portion and a forwardly directed portion.

12. The manually operated jack plate as described in claim 11 with the jack plate further comprising:

each transom mount element having a transom surface and a rearward surface with a thickness there between; and each motor mount element having a motor surface and a forward surface with a thickness there between.

* * * * *